United States Patent [19]

Jamison

[11] Patent Number: 4,667,833

[45] Date of Patent: May 26, 1987

[54] MODULAR DISPLAY STRUCTURES

[76] Inventor: Albert L. Jamison, 10318 Maybrook Ave., Whittier, Calif. 90603

[21] Appl. No.: 759,337

[22] Filed: Jul. 26, 1985

[51] Int. Cl.[4] ..... A47F 57/00

[52] U.S. Cl. ..... 211/198; 160/135

[58] Field of Search ..... 211/198, 199, 169, 195; 160/135, 351; 40/605, 606, 610

[56] References Cited

U.S. PATENT DOCUMENTS

| | | | |
|---|---|---|---|
| Re. 30,777 | 10/1981 | Ytter | 160/135 |
| 534,020 | 7/1895 | Holmes | 211/198 |
| 1,078,248 | 11/1913 | Buchner | 211/149 |
| 3,232,370 | 2/1966 | Jaffe | 160/135 X |
| 3,319,801 | 5/1967 | Nordstrom | 211/199 |
| 3,559,814 | 2/1971 | Downing | 211/199 X |
| 3,571,999 | 3/1971 | Downing | 160/135 X |
| 3,630,309 | 12/1971 | Wenger | 160/135 X |
| 3,817,396 | 6/1974 | Markson | 160/135 X |
| 3,899,164 | 8/1975 | Newman | 248/454 X |
| 3,908,787 | 9/1975 | Wenger et al. | 160/351 X |
| 3,908,830 | 9/1975 | Skrzelowski | 248/205.2 X |
| 3,975,850 | 8/1976 | Giaume | 211/198 X |
| 4,030,219 | 6/1977 | Donovan | 160/135 X |
| 4,194,313 | 3/1980 | Downing | 160/135 X |
| 4,214,392 | 7/1980 | Virsen | 160/135 X |
| 4,444,240 | 4/1984 | Bannister | 160/135 |
| 4,573,513 | 3/1986 | Small et al. | 160/351 X |

*Primary Examiner*—Ramon S. Britts
*Assistant Examiner*—Sarah A. Lechok Eley
*Attorney, Agent, or Firm*—Boniard I. Brown

[57] ABSTRACT

A portable knockdown structure for use in supporting displays at trade shows and the like. The structure includes one or more modules which are connectable edge-to-edge. Generally, each module includes a pair of display support frames hinged together in a manner to allow the two frames to form a predetermined stable obtuse angle therebetween. The lower edge of the lower frame contacts the floor as does a T-shaped leg which extends from the upper portion thereof. A swinging link connected for rotation to the upper frame and removably bolted to the T-shaped leg forces the upper frame into the obtuse angle engagement with the lower frame to form a stable structure. Thereafter the lower frame supports a display panel at an upwardly facing angle for ease of viewing and the upper frame supports a display with a slightly downward angle for ease of viewing and reduced glare. The modules may include auxiliary devices, such as lights and shelves which connect to the frame by clamps, bolts, or hook and pile fasteners. The display panels usually are retained to the frames by hook and pile fasteners.

18 Claims, 14 Drawing Figures

FIG. 10
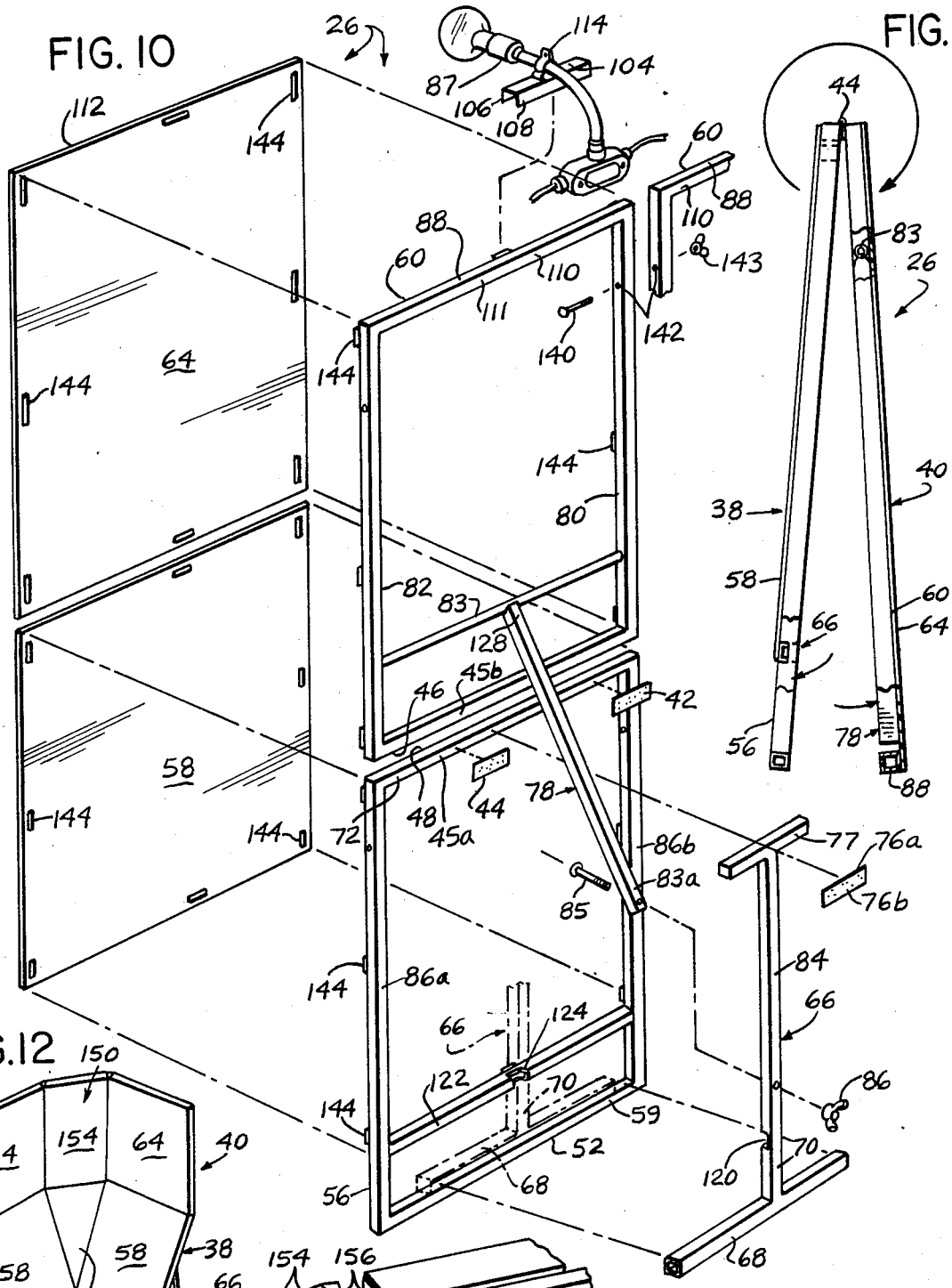
FIG.11
FIG.12
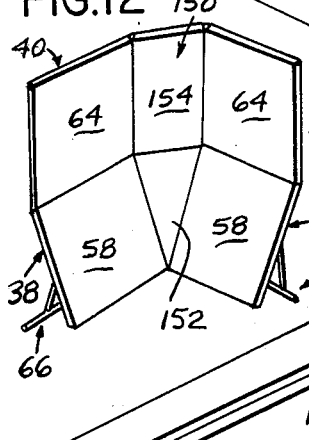
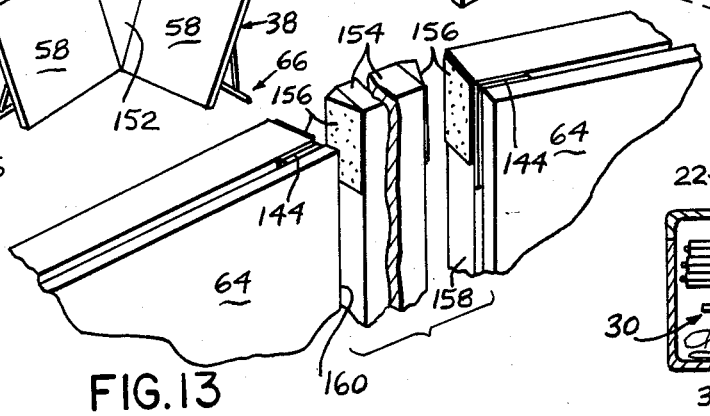
FIG.13
FIG.14
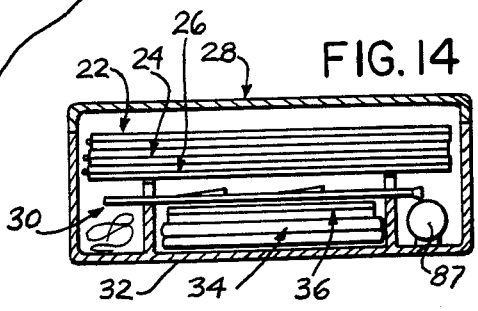

MODULAR DISPLAY STRUCTURES

BACKGROUND OF THE INVENTION

Many manufacturers use trade shows as a primary marketing tool for their product. Such trade shows are normally held in various convention centers about the country throughout the year. For the payment of a fee, space can be acquired to market a product during the show. Usually, the space is provided for only a short time prior to and after the show. Therefore, any graphic displays used in the show must be erected and dismantled quickly. The available workers in a convention center can be overburdened by a sudden inundation of requests for construction, electrical, and manual labor resulting in premium overtime labor rates. Therefore, the use of self-erectable structures which can be carried from show-to-show to provide the desired displays is much more economical than the use of on-site constructed structures for the displays at each show. Heretofore, portable structures to support displays have been expensive, complex to erect, unstable or too heavy to be conveniently portable. Therefore, there has been a need for a simple economic display system which is adaptable to various needs, can include its own lighting and which presents graphic displays in an attractive manner which avoids harsh glares.

BRIEF DESCRIPTION OF THE PRESENT INVENTION

The present invention is a modular display structure which can be assembled in many forms to fulfill the requirements of a particular marketer at shows where a permanent or on site constructed display structure is impractical. Basically, each module of the structure includes an upper and lower frame. The frames are connected together by a suitable flexible hinge so that they can be rotated slightly over 180° and into engagement with each other to maintain that angle. The lower structure includes a T-shaped leg pivotally mounted thereto for extending rearwardly to form a support for the module. A brace hingedly connected to the upper frame is then swung down and bolted to the T-shaped leg to form a stable structure. Adjacent modules are bolted together and display boards are fastened to the frame by suitable means such as hook and pile fasteners. Shelves can be connected to the structures either by bolting them to the frames through the displays or by attaching them to the displays with hook and pile fasteners. Light fixtures can be provided and connected to the frames usually to the upper frame to illuminate the displays. If the displays are transparent, some lights may be provided behind the transparencies. The entire modular structure as well as folding chairs, tables, and a folding construction ladder can be nested in a single transportation trunk so that an entire show facility can be transported from show-to-show with minimal trouble.

By supplying frames with special shapes, other than rectangular, displays can be created in corners or circles. By offsetting the supporting legs, the modules can be erected back-to-back. Therefore, just about any configuration of display can be created to fit a particular physical location.

Therefore it is an object of the present invention to provide a quickly and easily erectable display structure.

Another object is to provide a modular erectable display structure which is portable, economic to manufacture, and light weight.

Another object is to provide an erectable display structure which can accommodate various physical locations and requirements.

These and other objects and advantages of the present invention will become apparent to those skilled in the art after considering the following detailed Specification together with the accompanying drawings wherein:

BRIEF DESCRIPTION OF THE DRAWINGS

FIG. 10 is an exploded view of the construction of a structural module constructed according to the present invention;

FIG. 11 is a side elevational view showing how the frames forming a module structure can be folded;

FIG. 12 is perspective view of a corner structure constructed with the previously illustrated modules and a special corner module;

FIG. 13 is an enlarged detail view showing a connection method for the corner module of FIG. 12; and FIG. 14 is a cross-sectional view of the trunk of FIG. 1 showing how the elements required for a show can be stored therein.

DETAILED DESCRIPTION OF THE SHOWN EMBODIMENTS

Figure 1:
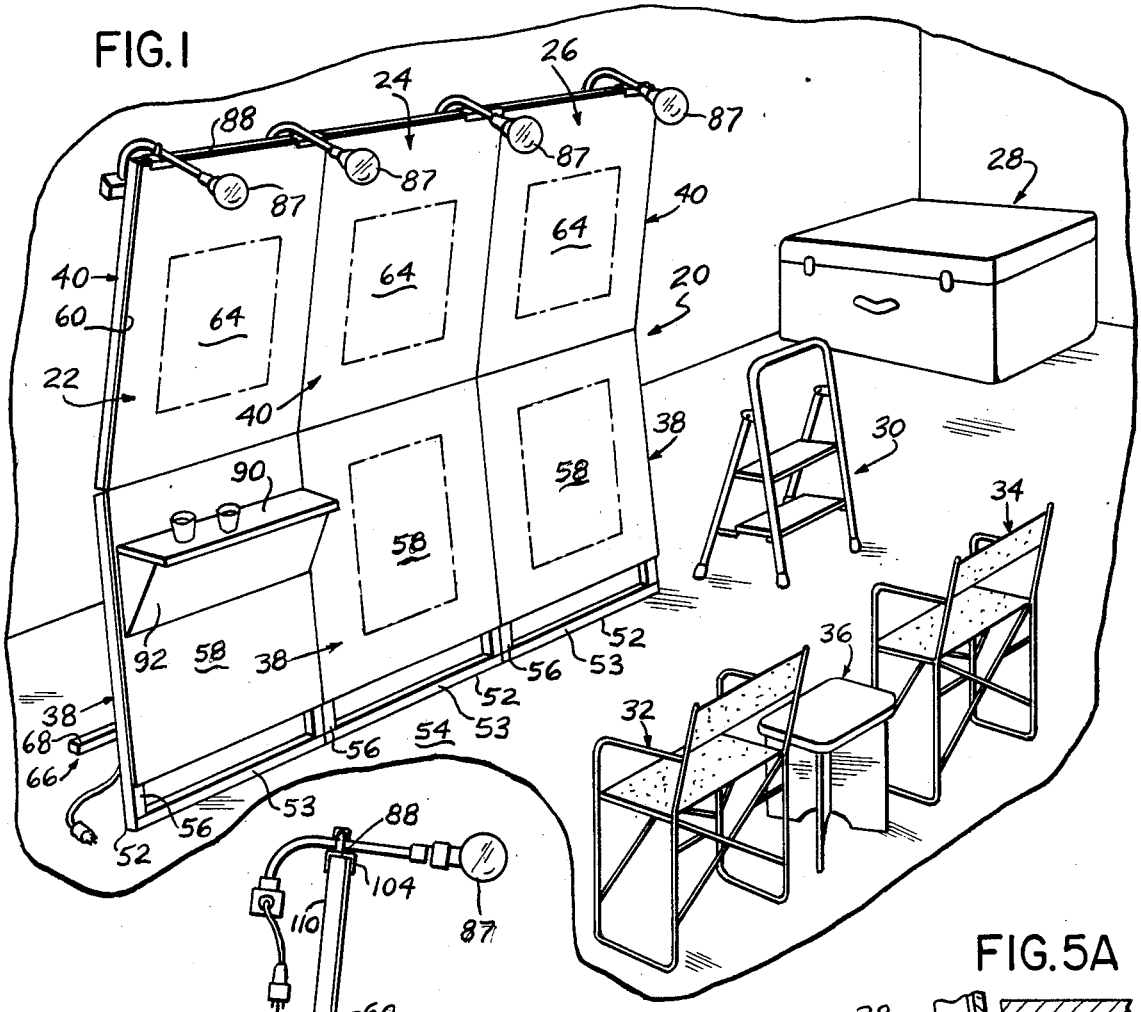
FIG. 1 is a perspective view of a typical show display employing a modular display structure constructed according to the present invention.

Referring to the drawings more particularly by reference numbers, number 20 in FIG. 1 refers to a modular display structure constructed according to the present invention. As shown, the structure 20 includes three display modules 22, 24 and 26. Other elements needed for a show display are also shown in FIG. 1, including a storage and travel trunk 28, a foldable step ladder 30, folding chairs 32 and 34, and a foldable table 36.

Figure 2:
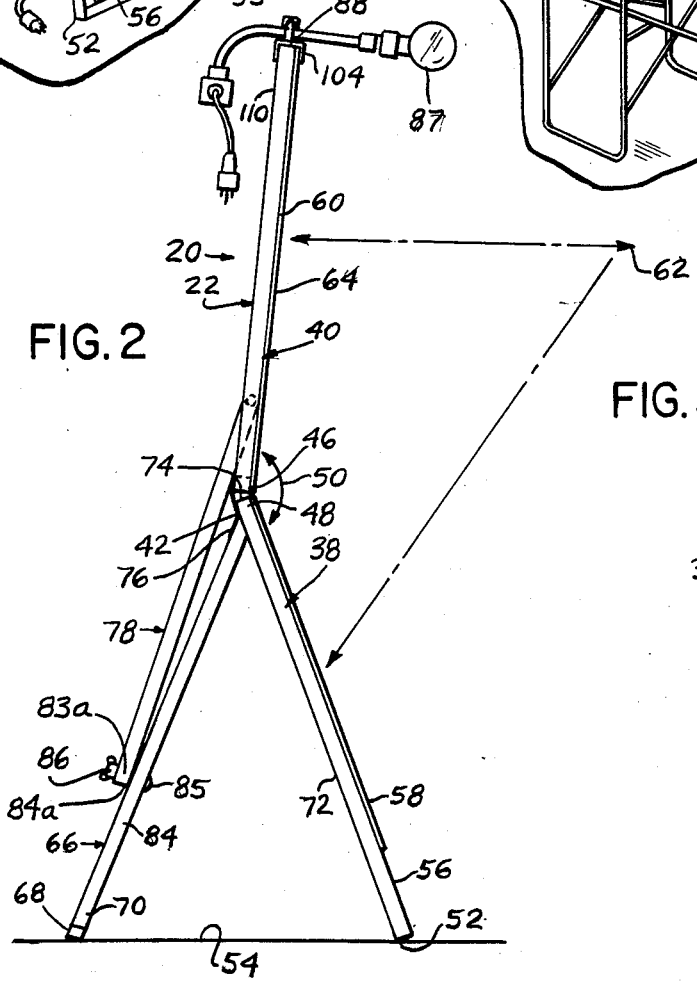
FIG. 2 is a side elevational view of a display module of FIG. 1.
Figures 3, 4, 6, 7, 7A, 8, 9:
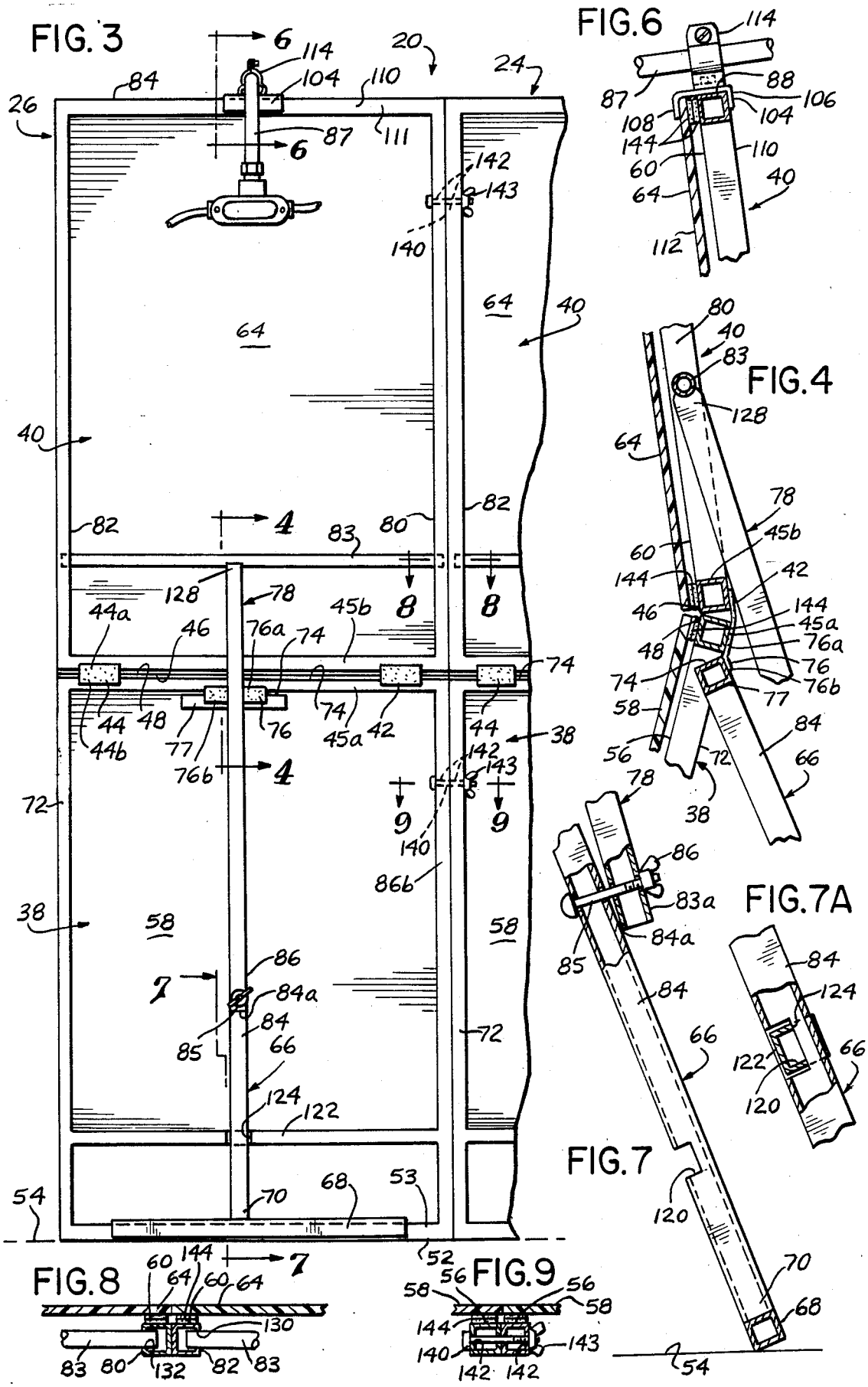
FIG. 3. is a rear elevational view of portions of the structure of FIG. 1.
FIG. 4 is an enlarged detail view taken at line 4—4 of FIG. 3.
FIG. 6 is an enlarged detail view taken at line 6—6 of FIG. 3.
FIG. 7 is an enlarged detail view taken at line 7—7 of FIG. 3.
FIG. 7A is an enlarged cross-sectional view of a portion of the structure shown in FIG. 7 when in its folded position.
FIG. 8 is an enlarged cross-sectional view taken at line 8—8 of FIG. 3.
FIG. 9 is an enlarged cross-sectional view taken at line 9—9 of FIG. 3.

The erected condition of the display modules can be seen with reference to display module 24 shown in FIG. 2. Each of the modules 22, 24 and 26 include a lower frame 38 and an upper frame 40 which are pivotally connected together by flexible plastic hinges 42 and 44 (FIGS. 3 and 4). The plastic flexible hinges 42 and 44, each of which have an upper portion 44*a* connected to the upper frame member 45*a* of the lower frame 38 and a lower portion 44*b* connected to the lower frame member 45*b* of the upper frame 40 allow the upper and lower frames 40 and 38 to be rotated until their front facing corners 46 and 48 abut, which stops their rotation at a stable obtuse angle 50.

When the lower edge 52, of a lower frame member 53 of the lower frame 38 is resting on a floor 54, it is supported with its front surface 56 leaning away from vertical so that a display board 58 attached thereto can be viewed by passersby without harsh glare. The front surface 60 of the upper frame 40 is maintained leaning forward of vertical to also diminish glare in a viewers eye 62 of a display board 64 connected to the upper frame 40. The two frames 38 and 40 are maintained in this position by means of a T-shaped leg 66 which has a horizontal member 68 for resting on the floor 54 at one end 70 and is pivotally connected to the back surface 72, of the upper frame member 45*a* of the lower frame 38 adjacent its upper edge 74 by means of another flexible plastic hinge 76 extending from a smaller T member 77. The upper portion 76*a* of the hinge 76 is connected to the upper frame member 45*a*, whereas its lower portion 76*b* is connected to the smaller T member 77. A brace 78 is pivotally connected between the sides 80 and 82 of the upper frame 40 by a horizontal rod 83. This allows the brace 78 to be rotated down vertically so that its lower end 83*a* can be connected at a point 84*a* along the leg 84 of the T-shaped leg member 66. When a connection between the two is made, such as by means of the bolt 85 and nut 86 shown, the module 26 and the others 22 and 24 constructed in the same manner are rigidly supported.

As shown in FIG. 3, if modules 22, 24 or 26 are to be used back-to-back, the leg members 66 and braces 78 can be constructed slightly offset in one direction in relation to the sides 80 and 82 of the upper frame 40 and the sides 86*a* and 86*b* of the lower frame 38 so that when arranged back-to-back, back-to-back legs and braces do not interfere with each other. Of course, back-to-back modules can be offset slightly to also provide this noninterference.

Figure 5A:
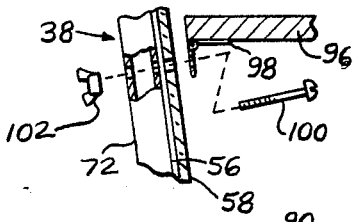
FIG. 5A is a view similar to FIG. 5 showing an alternate attachment method for the shelf of FIG. 5.
Figure 5:
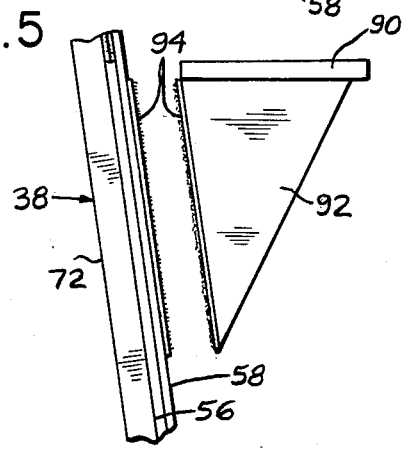
FIG. 5 is a side view showing an attachment method of a shelf.

The structure 20 is versatile in that it can accommodate light fixtures 87 which usually are connected to the upper edge 88 of the upper frame 40, and shelves, such as shown in FIGS. 5 and 5A. In FIG. 5, a shelf 90 is provided with a triangular support 92 and is connected directly to the display board 58 by means of a hook and pile fastener system 94, sometimes sold under the Dupont Trademark "Velcro." As shown in FIG. 5A, a shelf 96 can be provided with hinges 98 which are then fastened through the display board 58 and the frame 38 by means of bolts 100 and nuts 102. Since the light fixtures 87 can balance fore and aft on the upper edge 88, they are provided with a Q-shaped connector members 104 which have arms 106 and 108 which engage the back surface 110 of the upper frame member 111 of the upper frame 40 and the front surface 112 of the display board 64. Each member 104 is connected to a fixture 87 by means of a suitable clamp 114.

In FIG. 7, the details of how the bolt 85 and nut 86 are used to connect the T-shaped leg member 66 and the brace 78 are shown. It should be noted that a notch 120 can be provided in the leg 84 so that it can swing flush with the frame 38 whose intermediate lower cross brace 122 has a mating notch 124 to nest therewith as shown in FIG. 7A.

As shown in FIGS. 3 and 4, the brace 78 is connected to the upper frame 40 by the rod 83 connected to the opposite end 128 of the brace 78 from its end 83*a*. The rod 83 is engaged by cylindrical bearing surfaces 130 and 132 in the upper frame 40. Module to module connection is obtained by threading bolts 140 through aligned holes 142 in the frame sides which are then secured by wing nuts 143 as shown in FIG. 9.

As shown in FIG. 10, the display boards 58 and 64 are connected to the frames 38 and 40 by small matching patches of hook and pile fasteners 144 so that once a show is over, the light fixtures 87 can be removed easily by lifting, the display boards 58 and 64 can be removed by a slight tugging, and the upper and lower frames 40 and 38 can be rotated through slightly more than 180° to come into back-to-back engagement with their respective braces 78 and T-shaped leg members 66 folded therebetween as shown in FIG. 11.

When it is desired to erect the display structure 20 in a corner, a special shaped module 150 can be employed with a lower triangular frame 152 and an upper rectangular frame 154 to close the area between adjacent display modules 22, 24 or 26. Such modules 150 do not require support structures and, therefore, hook and pile fasteners 156 can be used on the adjacent edges 158 and 160 to merely stick the module 150 in place, as shown in FIG. 13. When the show is over, and it is desired to move on to the next show, the entire structure 20 including the supporting components can be folded and placed in the trunk 28, as shown in FIG. 14.

Thus there has been shown and described a novel display structure which fulfills all of the objects and advantages sought therefor. Many changes, modifications, variations and other uses and applications of the subject invention will, however, become apparent to those skilled in the art after considering this specification together with the accompanying drawings. All such changes, modifications, alterations and other uses and applications which do not depart from the spirit and scope of the invention are deemed to be covered by the invention which is limited only by the claims which follow.

What is claimed is:

1. A modular, portable structure for supporting visual displays above a surface, said structure including:

a first lower frame having:

a lower frame member adapted for resting on the surface; and an upper frame member positioned above said lower frame member of said first lower frame;

a first upper frame having:

first upper means for attachment of a display thereto;

a lower frame member; and an upper frame member positioned above said lower frame member of said first upper frame;

first hinge means pivotally connecting said upper frame member of said first lower frame to said lower frame member of said first upper frame for rotation slightly over 180° whereby said first frames can be rotated from a side-to-side parallel relationship slightly over 180° to an obtuse angular relationship;

a first leg having:

an upper end pivotally attached to said first lower frame;

a lower end adapted to rest on the surface; and a intermediate portion between said upper and lower ends; and a first brace having:

an upper end pivotally attached to said first upper frame; and a lower end adapted for releasable engagement with said intermediate portion of said first leg to maintain said first frames in said obtuse angular relationship.

2. The structure as defined in claim 1 wherein said first hinge means include:

at least one flexible sheet hinge having:

a first portion connected to said upper frame member of said first lower frame; and a second portion connected to said lower frame member of said first upper frame, said at least one flexible sheet hinge being sized to allow said obtuse angular relationship to be established as said upper frame member of said first lower frame comes into contact with said lower frame member of said first upper frame.

3. The structure as defined in claim 2 wherein said first hinge means include:

a second flexible sheet hinge having:

a first portion connected to said upper frame member of said first lower frame; and a second portion connected to said lower frame member of said first upper frame, said at least one flexible sheet hinge being sized to allow said obtuse angular relationship to be established as said upper frame member of said first lower frame comes into contact with said lower frame member of said first upper frame.

4. The structure as defined in claim 2 wherein said first leg further includes:

a flexible sheet leg hinge having:

a first portion connected to said upper frame member of said first lower frame; and a second portion connected to said upper end of said first leg.

5. The structure as defined in claim 4 wherein said first lower frame includes:

first and second side members extending between said upper and lower frame members of said first lower frame, said first leg being connected to said upper frame member of said first lower frame member by said flexible sheet leg hinge closer to said first side member than to said second side member.

6. The structure as defined in claim 4 wherein said first lower frame includes:

first and second side members extending between said upper and lower frame members of said first lower frame; and an intermediate member extending between said first and second side members, said intermediate member including:

a member notch formed therein, and wherein said first leg includes:

a leg notch formed therein and positioned to nest with said member notch when said first leg is pivoted toward said first lower frame.

7. The structure as defined in claim 6 wherein said first leg is sized so that said lower end thereof can be rotated in above said lower frame member of said first lower frame.

8. The structure as defined in claim 1 wherein said upper frame member of said first lower frame includes:

a rear surface, and wherein said first leg upper end includes:

a rear surface, said first hinge means further including:

a flexible sheet leg hinge having:

a first portion connected to said rear surface of said upper frame member of said first lower frame; and a second portion connected to said rear surface of said upper end of said first leg whereby said first leg can be rotated within said first lower frame.

9. The structure as defined in claim 8 wherein said first lower frame includes:

first and second side members extending between said upper and lower frame members of said first lower frame; and an intermediate member extending between said first and second side members, said intermediate member including:

a member notch formed therein, and wherein said first leg includes:

a leg notch formed therein and positioned to nest with said member notch when said first leg is rotated within said first lower frame.

10. The structure as defined in claim 9 wherein said first leg is sized so that said lower end thereof can be rotated in above said lower frame member of said first lower frame.

11. The structure as defined in claim 10 further including:

a second lower frame having:

means for connection to said first lower frame;

a lower frame member adapted for resting on the surface; and an upper frame member positioned above said lower frame member of said second lower frame;

a second upper frame having:

means for connection to said first upper frame;

second upper means for attachment of a display thereto;

a lower frame member; and an upper frame member positioned above said lower frame member of said second upper frame;

second hinge means pivotally connecting said upper frame member of said second lower frame to said lower frame member of said second upper frame for rotation slightly over 180° whereby said second frames can be rotated from a side-to-side parallel relationship slightly over 180° to an obtuse angular relationship;

a second leg having:

an upper end pivotally attached to said second lower frame;

a lower end adapted to rest on the surface; and a intermediate portion between said upper and lower ends; and a second brace having:

an upper end pivotally attached to said second upper frame; and a lower end adapted for releasable engagement with said intermediate portion of said second leg to maintain said second frames in said obtuse angular relationship.

12. The structure as defined in claim 10 wherein said first upper frame includes:

first and second side members extending between said upper and lower frame members of said first upper frame, said first and second side members being spaced apart and defining:

facing bearings therein, said upper end of said first brace including:

a horizontal rod having opposite ends engaged with said facing bearings of said first and second side members for pivotal attachment thereto.

13. The structure as defined in claim 12 further including:

a display, wherein said first upper means for attachment of a display to said first upper frame include: a plurality of hook and pile fasteners.

14. The structure as defined in claim 12 further including:

an upper display, wherein said first upper means for attachment of a display to said first upper frame include:

a plurality of hook and pile fasteners on said upper display of said first upper frame;

a lower display; and first lower means for attachment of said lower display to said first lower frame, said first lower means for attachment including:

a plurality of hook and pile fasteners on said lower display of said first lower frame.

15. The structure as defined in claim 14 further including:

at least one light fixture adapted for attachment to said upper frame member of said first upper frame.

16. The structure as defined in claim 15 further including:

at least one shelf adapted for attachment to said lower display.

17. The structure as defined in claim 16 wherein said lower end of said first leg includes:

a horizontal foot for resting on the surface.

18. The structure as defined in claim 17 wherein said lower frame member of said first upper frame includes:

a rear surface, and said first hinge means include:

at least one flexible sheet hinge having:

a first portion connected to said rear surface of said upper frame member of said first lower frame; and a second portion connected to said rear surface of said lower frame member of said first upper frame, said at least one flexible sheet hinge being sized to allow said obtuse angular relationship to be established as said upper frame member of said first lower frame comes into contact with said lower frame member of said first upper frame.

* * * * *